United States Patent [19]

Mochida

[11] Patent Number: 4,772,916

[45] Date of Patent: Sep. 20, 1988

[54] MULTI-COLOR IMAGE FORMING APPARATUS

[75] Inventor: Yoshinori Mochida, Kawasaki, Japan

[73] Assignee: Canon Kabushiki Kaisha, Tokyo, Japan

[21] Appl. No.: 73,219

[22] Filed: Jul. 14, 1987

[30] Foreign Application Priority Data

Jul. 16, 1986 [JP] Japan ..... 61-167297
Jul. 16, 1986 [JP] Japan ..... 61-167298
Jul. 16, 1986 [JP] Japan ..... 61-167299

[51] Int. Cl.[4] ..... G03G 15/01

[52] U.S. Cl. ..... 355/4; 355/3 DD; 355/3 TR

[58] Field of Search ..... 355/4, 3 DD, 3 TR, 14 D, 355/14 TR, 3 R, 14 R

[56] References Cited

U.S. PATENT DOCUMENTS 4,593,991 6/1986 Aoki et al. .
4,615,612 10/1986 Ohno et al. .
4,620,783 11/1986 Tanaka et al. .
4,646,679 3/1987 Ohno et al. .
4,697,915 10/1987 Hayashi et al. ..... 355/14 D
4,707,108 11/1987 Ohno ..... 355/3 DD
4,723,145 2/1988 Takada et al. ..... 355/3 TR

*Primary Examiner*—R. L. Moses

*Attorney, Agent, or Firm*—Fitzpatrick, Cella, Harper & Scinto

[57] ABSTRACT

A multi-color image forming apparatus includes a developing device for developing at a developing station the latent image formed on an image bearing member, the developing device including plural developing units containing different color developers, respectively, which units are selectively movable to the developing station, image transfer device for transferring an image developed by the developing device onto a transfer material, provided with transfer material carrying drum for carrying the transfer material along an endless path in a predetermined direction and for contacting it to the image bearing member for the transfer material to receive the developed image, and a mechanism for moving a selected one of the developing units to the developing station during a period in which $L3 \geqq L2 \geqq L1$ is satisfied, where L1 is a length of the transfer material carried on the transfer drum which is measured from the transfer station to a trailing edge of the transfer material in a direction opposite to the predetermined direction, L2 is a length of the image bearing member which is measured from the developing station to the transfer station, and L3 is a length of the transfer material carried on the transfer material carrying member which is measured from the transfer station to a leading edge thereof in the opposite direction.

17 Claims, 8 Drawing Sheets

MULTI-COLOR IMAGE FORMING APPARATUS

FIELD OF THE INVENTION AND RELATED ART

The present invention relates to a multicolor image forming apparatus wherein plural developing units containing different color developers are sequentially brought to a developing station to develop respective latent images formed on an image bearing member, thus producing plural developed images in different colors, which are sequentially transferred onto one transfer material in alignment with each other to form a multicolor image.

In the field of such an image forming apparatus, it is known as disclosed in U.S. Pat. Nos. 3,987,756; 4,030,445 and 4,622,916, for example that in order to reduce the size of an image bearing member on which a latent image to be developed is formed and also to reduce the size and cost of the image forming apparatus, the developing units for different colors are not disposed around the circumference of the photosensitive drum but are carried on a revolvable support or turret so as to be selectively brought to a common developing station for performing the developing operation.

The developed images of different colors produced by the revolver type developing device, are sequentially transferred onto a transfer material which is kept supported on a transfer material carrying member (a transfer material drum, for example) in contact with the photosensitive drum and is movable along an endless path, so as to form a multicolor image on one transfer material This system is useful in practice, but the inventors have found some problems to be solved.

SUMMARY OF THE INVENTION

In the type of the image forming apparatus wherein developing units are selectively introduced into the developing station where the developing operation is effected, the inventors have found that there is a possibility that the developer is undesirably deposited onto an area of the photosensitive drum outside the intended developing area, and that the cause is due to the fact that at the instance when a developing unit is set to the developing position or when it starts to move away from the developing station, the developer on a developing sleeve of the developing unit is brought into contact with the photosensitive drum. If the developer is transferred onto the transfer material moving in contact with the photosensitive drum, it appears in the resultant image as a thick band extending substantially perpendicularly to the direction of the transfer material movement, thus deteriorating the resultant image.

Considering the peripheral length of the transfer drum (the transfer material carrying member), the circumferential length is required to be larger than the length of the maximum size transfer material usable with the multi-color image forming apparatus. It is preferable that the circumferential length is approximately equal to the length of such a transfer material from the standpoint of reducing the size of the apparatus. In any event, it is not preferable to make the length larger than necessary.

When the size of the transfer material is smaller than the maximum size, for example, approximately one half thereof, as is frequently the case in this type of machine, the transfer drum does not carry the transfer material in approximately one half of the entire circumferential length. When this empty part of the transfer drum is in contact with the photosensitive drum, the image formation is not effected to the transfer material. In consideration of these, the circumferential length of the transfer drum is made approximately equal to the maximum length of the usable transfer material from the standpoint of increasing the overall image forming speed. For this reason, there is only a limited area that does not carry the transfer material when the maximum size transfer material is carried on the transfer material.

On the other hand, for a developing device of this type, after a developing operation is completed for the first color, the second color developing unit is brought to the developing station prior to the beginning of the second color developing operation. Those movements of the developing units are required to be performed and completed during the time period corresponding to movement of the transfer drum circumferential through the length of difference between the entire circumferential length of the transfer drum and the length of the transfer material.

However, as discussed hereinbefore, for the purpose of reducing the size of the apparatus and increasing the overall image forming process speed, particularly when a smaller size transfer material is used, it is desirable that the circumferential length of the transfer drum is approximately equal to the maximum size transfer material, and therefore, the time period afforded to movements of the developing units are not assured to be sufficient when a larger size transfer material is used.

In order to solve this problem, it is considered that immediately after the completion of the developing operation for the first color, the speed of the transfer drum is reduced or once stopped, thus providing a sufficient time period for the preparation of the second color developing operation. The result, however, is a complicated control system for the transfer drum rotation.

An alternative way is to reduce the time required for the movements of the developing units by quickly moving and quickly stopping the developing units. However, the results are a shock and vibration imparted to the photosensitive drum and the developing unit support or the like, by which the resultant image becomes non-uniform. Particularly, if it is the photosensitive drum that is vibrated by the setting and withdrawing movements of the developing units with respect to the developing position, the problem arises that misregistration and non-uniformness (the transfer efficiency varies due to the vibration) take place. This is because the more or less distance between the developing station and the transfer station provide a time difference between the execution of the developing process and that of the transfer process, that is, at the instance when the developing operation is completed at the developing station, the transfer operation still continues to be carried out at the transfer station. Therefore, if the developing unit is moved immediately after the completion of the developing operation, it will adversely affect the transfer operation.

In addition, if the photosensitive drum is vibrated while being exposed to image information, the image exposure at the exposure station becomes nonuniform.

As discused above, the timing of moving the developing unit, particularly that of setting it to the developing station or that of starting to move it away from the developing station are very important.

Accordingly, it is a principal object of the present invention to provide a multi-color image forming apparatus in which the transfer material is not contaminated by unnecessary developer.

It is another object of the present invention to provide a multi-color image forming apparatus in which image exposure operation can be effected without production of non-uniform image exposure.

It is a further object of the present invention to provide a multi-color image forming apparatus wherein misregistration and non-uniformness of the transferred image are effectively prevented, so as to provide a high quality image.

It is a further object of the present invention to provide a multi-color image forming apparatus which is small in size.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Figure 1:
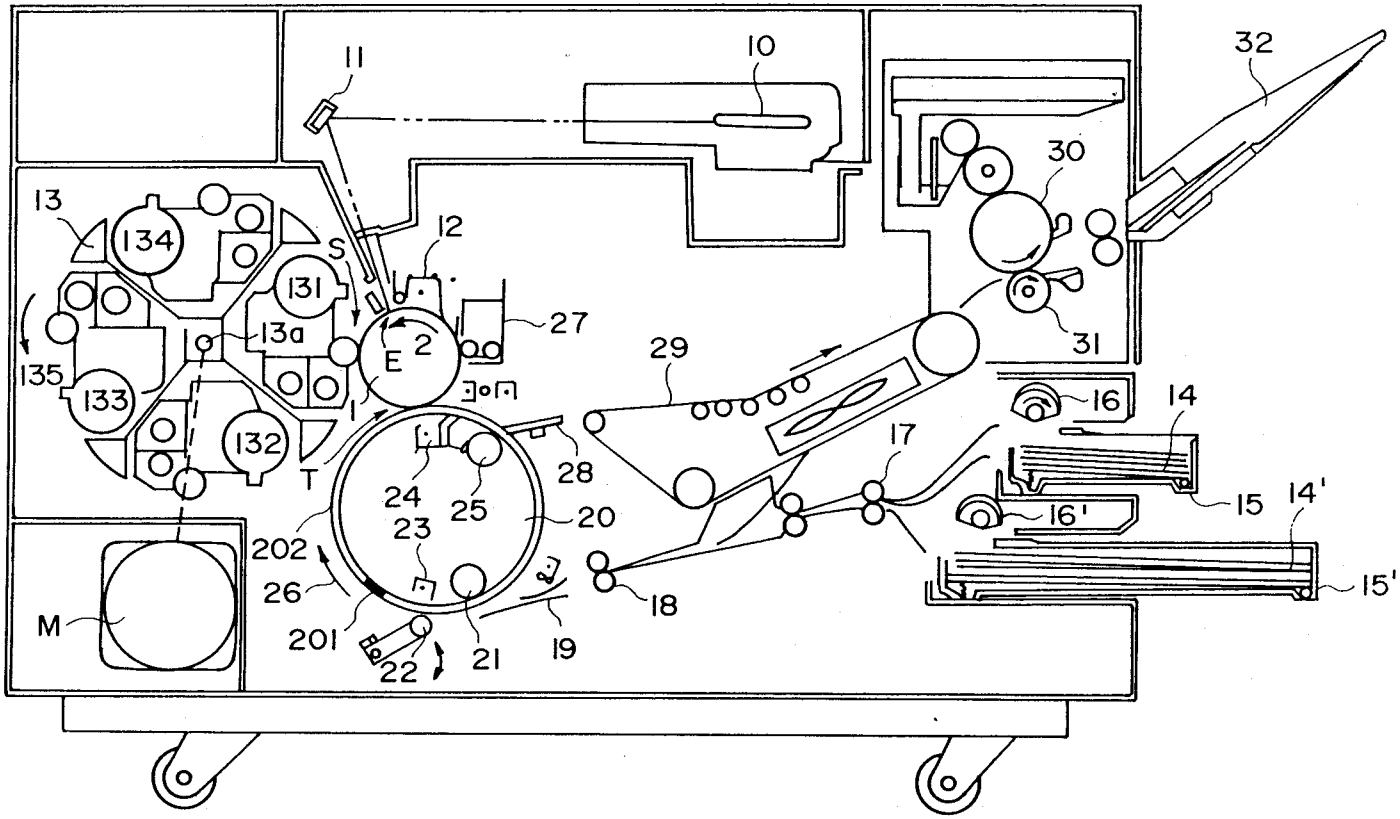
FIG. 1 is a sectional view of a multi-color image forming apparatus to which the present invention is applicable.

Referring to FIG. 1, there is shown a multi-color image forming apparatus in the form of a printer in this example, of an electrophotographic type, into which the present invention is incorporated.

The apparatus or printer includes an image bearing member in the form of a photosensitive drum 1, which is rotatable in the direction indicated by directional arrow 2. Around the periphery of the photosensitive drum 1, there are disposed a charger 12, a developing unit supporting frame 13, a transfer drum 20 for supporting and carrying a transfer material and a cleaning device 27, the transfer drum 20 being movable along an endless path. A laser optical system 10 and 11 produces a laser beam modulated by a color-separated image information, which beam scans the surface of the photosensitive drum 1 which has been electrically charged by the charger 12. By this exposure of the photosensitive drum 1 to the laser beam, a latent image is formed on the photosensitive drum 1 in accordance with the image information. Designated by reference numeral 10 is a polygonal mirror to deflect the laser beam produced by an unshown laser source relative to the photosensitive drum 1; and the reference 11 a reflecting mirror for reflecting the laser beam toward the photosensitive drum 1.

The developing unit support frame 13 supports a developing unit 131 accommodating a yellow (Y) developer, a developing unit 132 containing a magenta (M) developer, a developing unit 133 containing a cyan (C) developer and a developing unit 134 containing a black (BK) developer. The developing unit support 13 is rotatable by driving means M in the direction of an arrow indicated by reference numeral 135 about a shaft **13*a* to revolve the developing units. When a latent image on the photosensitive drum 1 is to be developed, the developing unit support 13 is rotated to bring a selected one of the developing units containing the desired color developer to a developing station S which is common to all of the developing units, where the developing operation is performed. In this manner, the developing station S can be selectively loaded with different color developing units 131, 132, 133 and 134. In the Figure, the developing unit 131** containing the yellow developer is shown as being set at the developing station S.

The apparatus is provided with a cassette 15 accommodating transfer materials 14 which are usually in the form of a sheet of plain paper. The transfer material 14 within the cassette 15 is fed out of the cassette 15 one by one by a pick-up roller 16 and is conveyed to a sheet guide 19 by way of a first registration roller couple 17 and a second registration roller couple 18. The apparatus is loaded with an additional cassette 15' accommodating transfer materials having a larger size than the transfer sheet 14. The transfer material 14' is picked up by a pick-up roller 16' from the cassette 15'.

The fed transfer material is conveyed to the transfer drum 20 at suitable timing controlled by the first and second registration rollers 17 and 18, and the leading edge 142 thereof is gripped by a gripper 201. The transfer sheet gripped thereby at the leading edge 142 is passed between an attracting charger 23 and a friction roller 22, and is attracted and supported on the transfer drum 20 in the entirety of the sheet on an attracting sheet 202 on the transfer drum 20. Onto the transfer material, a developed image on the photosensitive drum 1 is transferred by the transfer charger 24. The image transfer process is repeated for the different colors, and upon completion of all the colors, the gripper 201 is released. Then, the transfer material is separated from the transfer drum 20 by a separation pawl 28, and is guided to the conveying portion 29, by which the transfer material is introduced into the image fixing device constituted by a couple of fixing rollers 30 and 31, where the image transferred is fixed into a permanent image. Then, it is discharged onto a tray 32. The developer remaining on the photosensitive drum 1 after the image transfer, is removed by the cleaning device 27 from the photosensitive drum so as to prepare the drum 1 for the next image forming operation. The gripper 201 is operated by cams 25 and 21.

Figure 2:
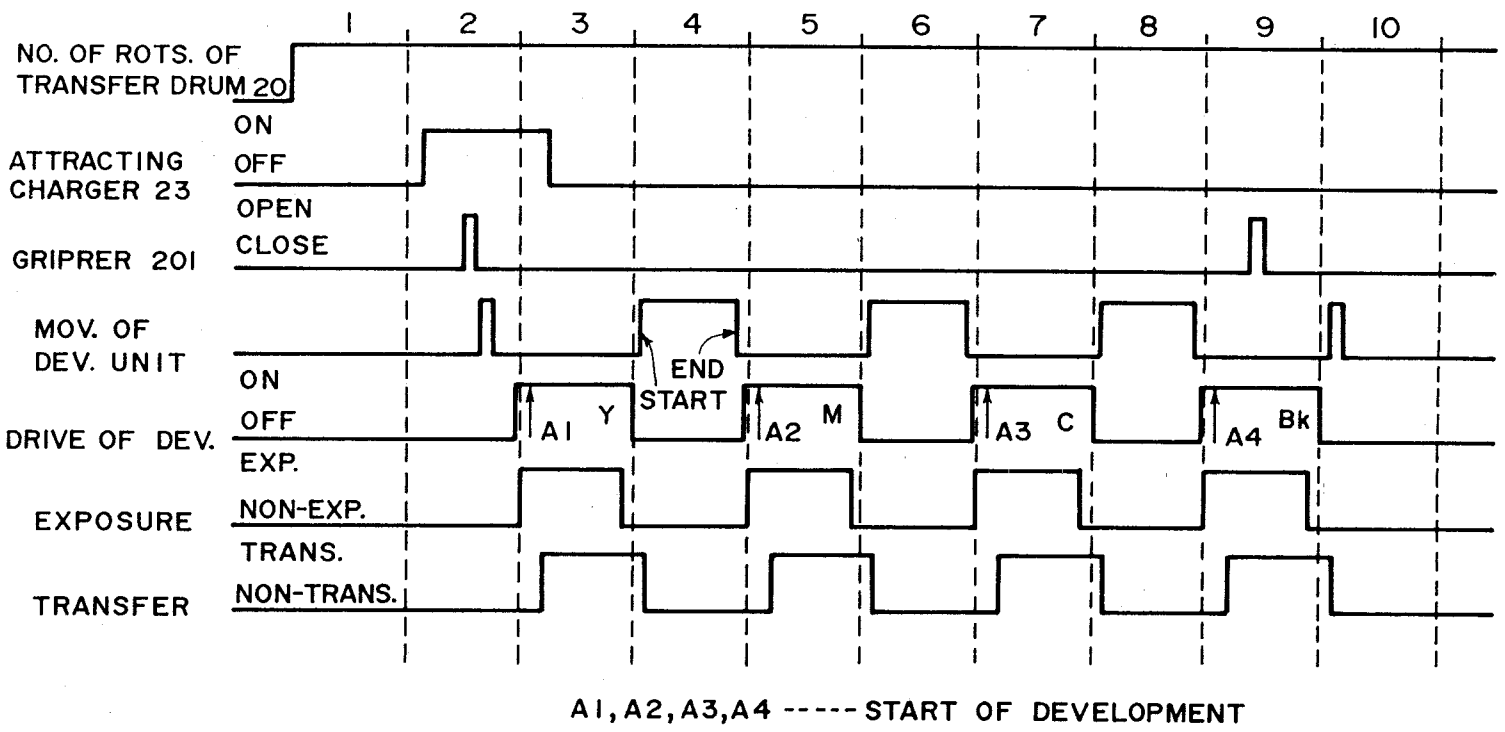
FIG. 2 is a timing chart illustrating the time relation between a developing unit movement and an image forming process according to an embodiment of the present invention.

FIG. 2 shows the relationship between the image forming process and the movement timing of the developing unit when a pictorial or full-color image is formed through yellow development, magenta development, cyan development and black development in the order named.

The transfer material fed out of the cassette 15 is properly synchronized by the second registration roller 18, and is received by the then open gripper 201, and subsequently gripped thereby. The transfer material is then attracted on an attracting sheet 202 by means of the attracting charger 23 and the friction roller 22, while it is being conveyed toward the transfer station T.

Initially the developing unit support 13 takes such a position that none of the developing units are in the developing station where a developing unit is opposed to the photosensitive drum 1. The developing unit support 13 starts to rotate so as to bring the yellow (Y) developing unit 131 to the developing station S. After the developing unit 131 is stopped at the developing station S, the developing sleeve therein starts to rotate to prepare for the developing operation.

On the other hand, the laser optical system starts to form a latent image on the photosensitive drum 1 in accordance with image information for the first color. The latent image is developed at the developing station S, and the developed image is conveyed together with the rotation of the photosensitive drum 1 to the transfer station T, where the developed image is transferred by the transfer charger 24 onto the transfer sheet carried on the transfer drum 20.

One of the important features of the present invention is that the developing unit 131 does not begin to move immediately after the completion of the developing operation thereby. As will be understood from FIG. 3, at this time the image transfer operation is being effected to the transfer sheet at the transfer station. In the present invention, the start of the developing unit 131 movement is made at such timing that the following is satisfied:

$$L1 \leqq L2 \leqq L3$$

L2: a circumferential length of the photosensitive drum surface measured from the developing station S to the transfer station T in the direction of movement of the surface of the photosensitive drum 1, as indicated by the arrow 2 (L2 is a constant parameter); L1: a length of the transfer material measured from the transfer station T to the trailing edge **14*b* of the transfer material in a direction opposite to the direction of the transfer drum 20 movement (as indicated by an arrow 26 (Ll is a function of time)); L3: a circumferential length of the transfer drum 20 measured from the transfer station T to the leading edge 14*a* of the transfer material in a direction opposite to the direction of the transfer drum 20 movement, as indicated by an arrow 26**.

By starting movement of the developing unit at the above-described timing, the unnecessary developer which is unintentionally deposited onto the photosensitive drum due to movement of the developing unit is transferred, if any, to the area H of the transfer drum 20 surface which is not covered by the transfer material, that is, the area from the trailing edge **14*b* of the transfer material to the leading edge 4*a*** of the same, but in no way onto the transfer material.

Figure 3:
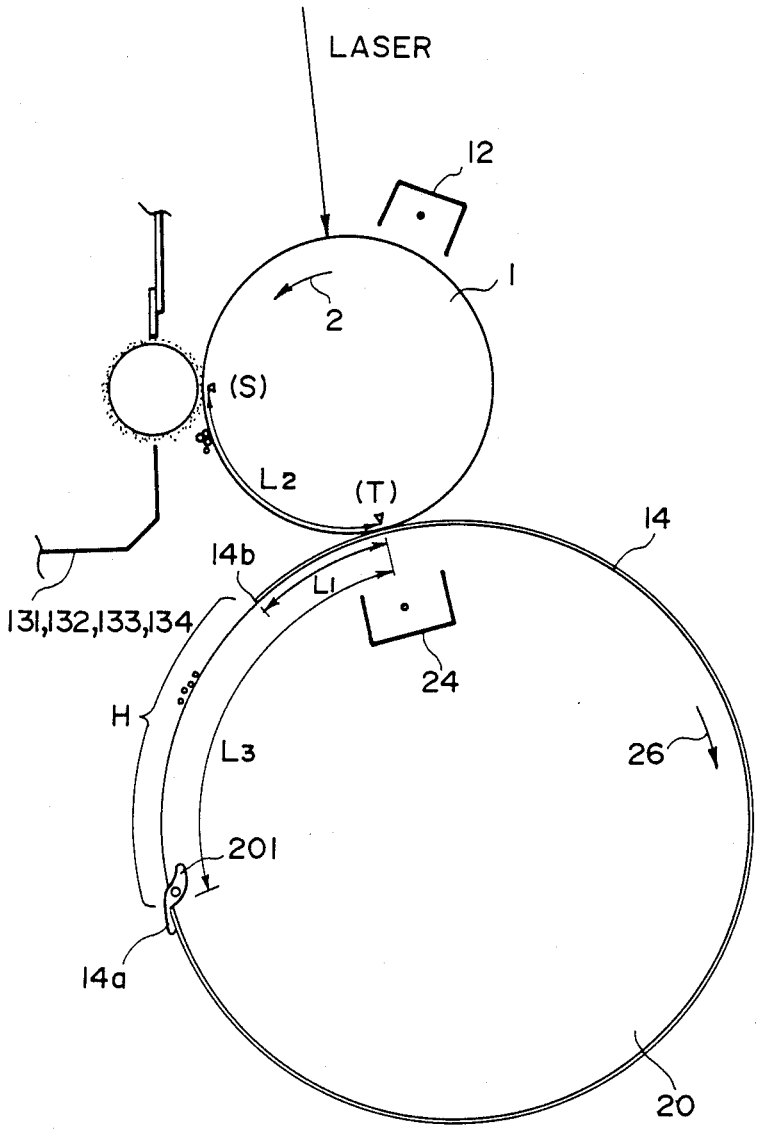
FIG. 3 is a sectional view of a part of an image forming apparatus according to the embodiment of the present invention to illustrate the timing of developing unit movement.

After the yellow developed image is transferred onto the transfer material, the transfer drum 20 continues rotating, that is, goes into an idle rotation, during which the developing unit revolves slowly. The rotation of the developing unit support 13 stops when the next color, that is, magenta (M) developing unit 132 reaches the developing station S. As shown in FIG. 3, wherein the transfer drum 20 is making the idle rotation, the timing of stopping the movement of the developing unit, similarly to the start thereof, satisfies:

$$L1 \leqq L2 \leqq L3$$

By doing so, the developer deposited onto the photosensitive drum by a mechanical pressure resulting when the developing unit 132 is opposed to the photosensitive drum at the developing station S, is not transferred onto the transfer material, although it can be transferred onto the portion H of the photosensitive drum.

The developing unit 132 now positioned at the developing station S starts to rotate the developing sleeve to prepare for the developing operation thereof.

Similarly to the case of the yellow image development, the exposure, developing and transferring operations are performed for the magenta image, cyan image and black image, respectively. As a result, the yellow image, magenta image, cyan image and black image are superimposedly transferred onto the same transfer material. The above-described timing is satisfied when the cyan developing unit 133 takes the place of the magenta developing unit 132, and when the black developing unit 134 takes the place of the cyan developing unit.

Immediately after the black image, that is, the final image starts to be transferred onto the transfer material, the gripper 201 opens, so that the transfer material is separated from the transfer drum 20 during the image transfer step, and then is conveyed to the image fixing device. After the completion of the image transfer operation, the developing unit supports 13 rotates to bring it to the home position, and then it stops.

In consideration of the time period for the developing unit movement and the time period required for reading the image, the transfer drum may be rotated through two full turns, for example, for one color image transfer process, depending on the size of the transfer material. More particularly, the developed image is indeed transferred completely during the first full turn, and the second rotation is all idle rotation to assure the movement of the developing unit and the reading of the image information. In such a case, it is advantageous to control the timing of the start and end of the developing unit movement in the manner described above, in that the unnecessary developer deposited on the photosensitive drum can be prevented from being attached to the transfer material contacted to the photosensitive drum not during the transfer operation, at the transfer position. Therefore, the image quality is improved.

The developer deposited onto the portion H of the transfer drum 20 is removed by an unshown cleaning means after the transfer material is separated from the transfer drum 20.

The above-described timing is different if the length of the transfer material is different. This may be accommodated by effecting proper control on the basis of the length of the transfer material which can be detected by the feeding registration roller or the cassettes.

Below, a description is provided as to the timing of the developing unit movement where the circumferential length of the transfer drum 20 is approximately equal to the length of a transfer material having a maximum usable size.

Figure 4:
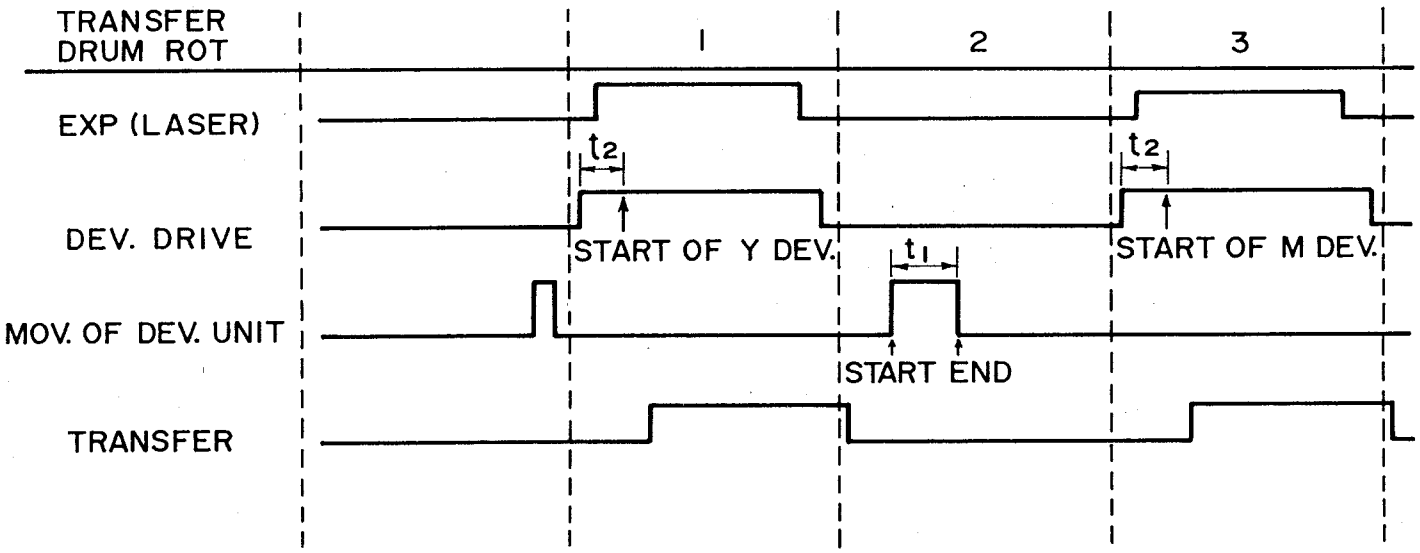
FIG. 4 is a timing chart illustrating the timing of the developing unit movement when an image is formed on a maximum usable transfer material.

FIG. 4 is a timing chart for the case of a larger size transfer material being selected, wherein the first color image formation (yellow in this embodiment) and the second color image formation (magenta in this example) are carried out.

Prior to start of the imagewise exposure for the first color image, the first color developing unit 131 is brought into the developing station S where it is opposed to the photosensitive drum. The developing sleeve thereof starts rotation some time ($t_2$ sec) before the start of the developing operation. When the latent image is formed and is brought to the developing station S, the yellow developing operation starts. At the transfer station T, the developed image is transferred onto the transfer material carried on the transfer drum 20. When the transfer drum 20 makes one full turn, the transfer of the image to the maximum size transfer material, that is, approximately equal to the circumferential length of the transfer drum, is completed. Then, when the transfer drum 20 goes into the next rotation, no image forming operation such as the image exposure and developing operation is performed during this next rotation. But, during the additional rotation, the developing unit support 13 carrying the yellow, magenta, cyan and black developing units starts movement in the direction of an arrow, and it stops after a timing interval of $t_1$ sec after the start, at which time the developing unit 132 is brought into the developing station S. The transfer drum then finishes the additional rotation and goes into the next rotation. The developing sleeve of the second color developing unit 132 starts rotation a time interval ($t_2$ sec) prior to the developing operation starts. When the latent image formed on the photosensitive drum is brought to the developing position S, the magenta transfer operation starts. At the developing station T, the second color, that is, the magenta color image is transferred superimposedly onto the yellow image carrying transfer material, while the transfer drum 20 rotates through approximately one full turn, so that the magenta image is transferred onto the maximum size transfer material.

Where a full color image is to be formed, the cyan and black developing units 133 and 134, respectively are operated after image formations for the yellow and magenta colors. The operations are the same for the cyan and black image formations.

Figure 5:
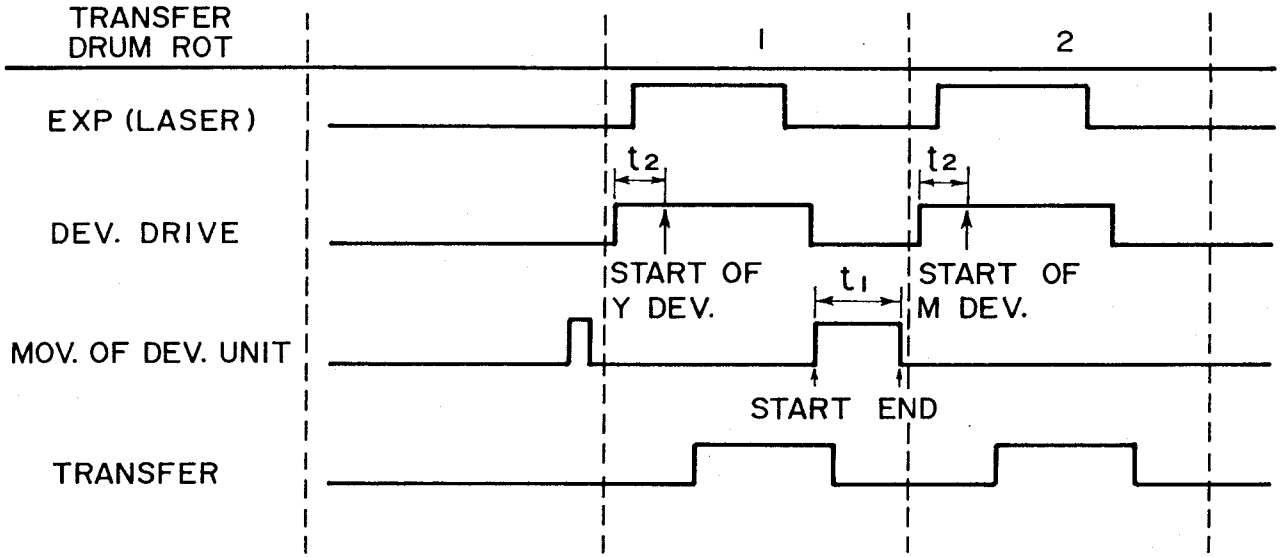
FIG. 5 is a timing chart illustrating the developing unit movement when the transfer material used is smaller than the maximum size.

FIG. 5 shows the timing of operations when the image is formed on a transfer material having a size smaller than the maximum size. In this Figure, the first color (yellow in this example) image formation and the second color (magenta in this example) image formation are illustrated. Similarly to the case of the maximum size transfer material, the first color developing unit 131 is placed in the developing station S prior to the start of the image exposure of the first color image. The developing sleeve starts rotation a time interval of $t_2$ sec before the start of the developing operation. When the formed latent image reaches the developing station S, the yellow developing operation starts. At the transfer station T, the developed image is transferred onto the transfer material carried on the transfer drum 20. Unlike the case of the maximum size transfer material, the image transfer is not effected to the entire length of the transfer drum. For example, if the length of the transfer material is one half that of the maximum size transfer material, the image transfer operation is performed only to one half of the transfer drum circumference. Immediately after completion of the first color developing operation, the developing unit support 13 starts rotation, and stops when the developing unit 132 reaches the developing station S. The time interval for this movement is $t_1$ sec. For the quick preparation of the developing operation, the developing sleeve of the developing unit 132 starts rotating a time interval of $t_2$ sec prior to the start of the developing operation. The latent image is formed by the image exposure, and when it comes to the developing station S, it is developed by the magenta toner. On the other hand, at the transfer station, the second color, that is, the magenta image is transferred superimposedly onto the transfer sheet now carrying the first color, that is, yellow image. When the transfer drum rotates one full turn, the image transfer onto the transfer material is completed.

When a full-color image is to be produced using the cyan and black developing units after the image formations by yellow and magenta developers, similar sequences are repeated, wherein the cyan and black developing units are moved to the developing station S.

According to the above described sequential operation, when a maximum size of the transfer material which is approximately equal to the full circumferential length of the transfer drum is selected, the transfer drum is given one additional rotation, and therefore the sufficient time required for movement of the developing units and for increasing the speed of the developing sleeve rotation to a sufficient extent can be afforded without adding a complicated speed control sequence, in other words with the same structure and arrangement as when the smaller size transfer material is used. Hence, the developing unit can be moved smoothly.

In the above described embodiment, the additional rotation is carried out when the maximum size transfer material is used, but it is not limited to the maximum size, but may be applied to the transfer material having a suitable size or greater.

A description will be made as to another embodiment wherein misregistration and/or non-uniform transfer which is possibly caused by movement of the developing units is effectively prevented.

Figure 6A:
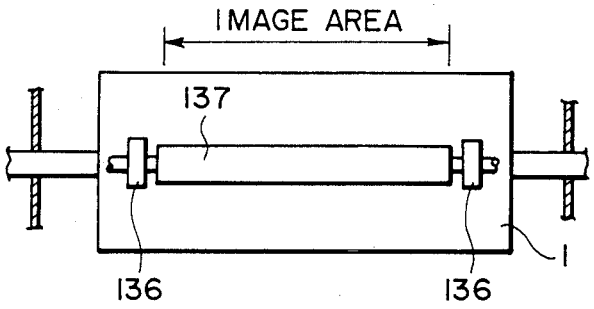
FIGS. 6A and 6B are somewhat schematic views illustrating the positional relationship between the developing unit and the photosensitive drum.
Figure 6B:
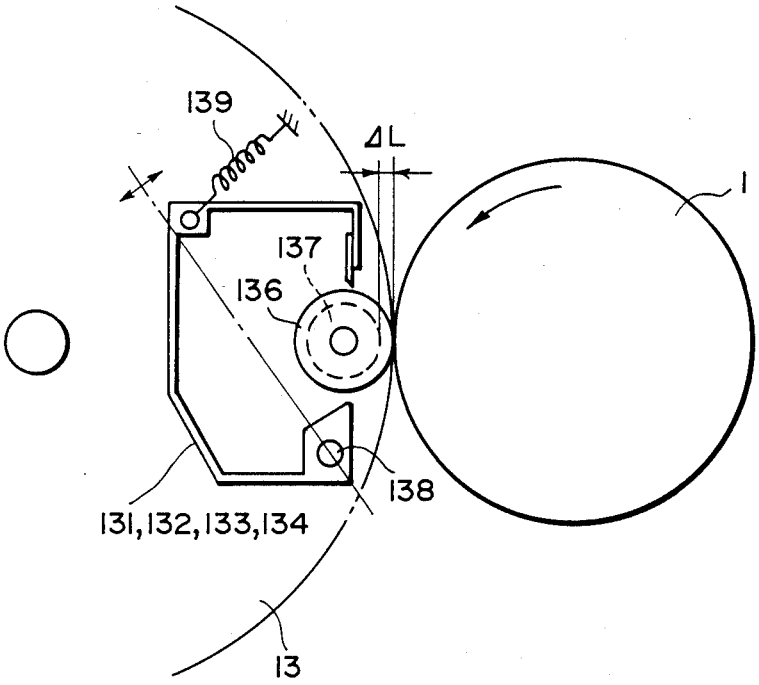

FIGS. 6A and 6B show an exemplary developing unit usable with this embodiment, wherein for the purpose of maintaining a constant clearance $\Delta L$ between the surfaces of the developing sleeve 137 and the photosensitive drum 1, the developing sleeve 137 is provided with coaxial rollers 136 outside the image forming area. The developing unit is more or less movable in a radial direction of the photosensitive drum 1, and a spring 139 is provided to urge the developing unit to keep the rollers 136 in contact with the surface of the photosensitive drum surface. As shown in FIG. 6B, the developing unit is swingable about a shaft 138, and is urged by a spring 139 having an end fixed on the developing unit support 13, so as to bring the rollers 136 into contact with the photosensitive drum. This is done for the purpose of avoiding non-uniform developing action which otherwise results from variation in the clearance $\Delta L$ between the developing sleeve 137 surface and the photosensitive drum surface. However, with this structure of the developing unit, when the driving power is supplied to the developing unit, a shock resulting from engagement of the teeth of driving gears or the like is transmitted to the photosensitive drum through the contact between the rollers 136 and the photosensitive drum. Additionally, the vibration of the developing unit which may result from a swingable mass of the developing unit starting movement is transmitted to the photosensitive drum in the same manner. Also, when the developing unit is being set into the developing station after start of its movement, the rollers 136 about the photosensitive drum, by which a shock or impact is given to the photosensitive drum to vibrate it.

If the shock or vibration takes place in the photosensitive drum during the image exposure or during the image transfer, the resultant image becomes nonuniform. To obviate these problems, the developing unit is moved at the following timing.

Figure 7:
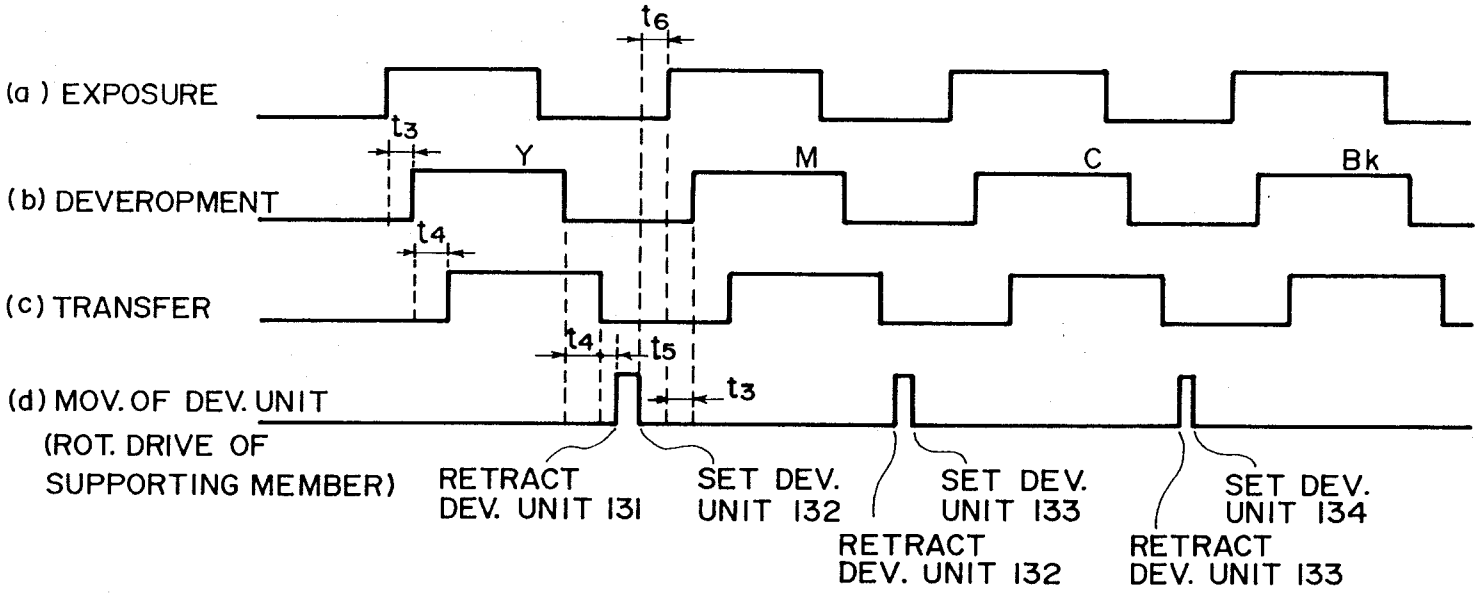
FIG. 7 is a timing chart illustrating the timing of developing unit movement.
Figure 8:
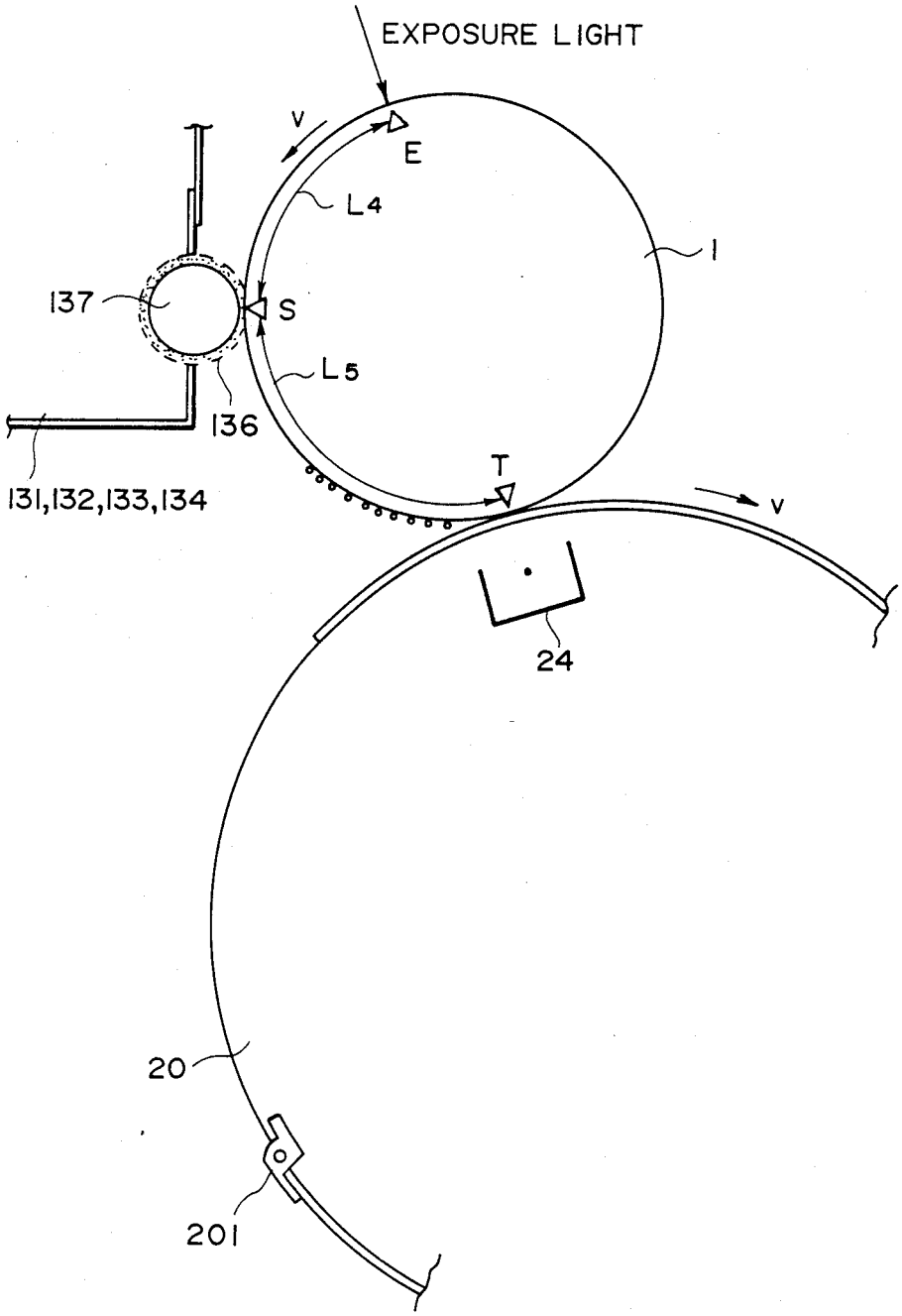
FIG. 8 is a somewhat schematic view illustrating the relationship among an exposure station, a developing station and a transfer station.

FIGS. 7 and 8 are for explaining this. The photosensitive drum 1 and the transfer drum 20 rotate in a direction indicated by arrows 2 and 26, respectively, at the same and constant peripheral speed v.

In FIG. 7, designated by (d) is a rotational drive signal for the developing unit supporting frame 13. As will be understood, when it changes from "L" level to "H" level, the developing units start to move, and when it changes from "H" level to "L" level, a desired developing unit is set in the developing position, and the movement terminates.

In the first developing operation, the image exposure starts at the exposure station E with the developing unit 131 being situated in the developing position S. At the developing station S, the yellow developing process starts after a time delay after commencement of latent image formation at the exposure station E, the time delay being $t_3$ (=L4/v) in which the latent image formed at the exposure station E reaches the developing station S by moving through the distance L4.

Then, at the transfer station T, the transfer process starts after a time delay after commencement of the developing operation at the developing station S, the time delay being $t_4$ (=L5/v) in which the developed image reaches the transfer station T by moving through the distance L5. As will be understood, even after the termination of the developing process, the transfer process continues for a period of time $t_4$. During this additional period $t_4$, if the developing unit starts to move, the shock and vibration caused by the movement is transmitted to the photosensitive drum, and the misregistration and non-uniform image transfer are introduced at the transfer station T which is then executing its process. Therefore, in the embodiment of the invention, the developing unit 131 starts to move or retract away from the photosensitive drum after a time delay ($=t_5 \geqq 0$) after completion of developing process. Then, the next developing unit 132 comes to the developing station S and is brought into contact with the photosensitive drum 1 by the rollers 136, whereupon it stops. If this movement is made during the time ($t_3$) after the start of the next image exposure and prior to the start of the developing process, the vibration of the photosensitive drum 1 resulting from the impact given by the developing unit coming into the developing station S produces nonuniform image exposure. In view of this, the movement of the developing unit 132 to the developing station S is completed, a time interval ($=t_6 \geqq 0$) prior to the start of the next image exposure operation.

Subsequently, the image forming process including the image exposure, the developing operation, the image transfer and movement of the developing unit is repeated for the magenta, cyan and black images, so that a color image is produced.

As described in the foregoing, according to this embodiment, the timing of the start and/or the end of the developing unit movement is controlled, so that the misregistration and/or non-uniformness of the transferred image does not result from the shock stemming from movement of the developing unit, at the transfer station S. Additionally, at the image exposure station E, the non-uniform image exposure does not result from the same. Therefore, uniform and high quality images can be produced.

In the foregoing, a full-color electrophotographic apparatus or printer has been taken as an example, but the present invention is applicable to a multi-color image forming apparatus capable of forming two color images, and is also applicable to a superimposing transfer apparatus wherein developing units are moved to a developing station where an image is developed, and then, the developed images are transferred onto a transfer material carried on a transfer drum. The image bearing member and the transfer material carrying member have been described as being in the form of a drum, one or all of them may be in the form of a belt.

While the invention has been described with reference to the structures disclosed herein, it is not confined to the details set forth and this application is intended to cover such modifications or changes as may come within the purposes of the improvements or the scope of the following claims.

What is claimed is:

1. A multi-color image forming apparatus, comprising:

a movable image bearing member;

means for forming a latent image on said image bearing member in accordance with information corresponding to a color component image;

developing means for developing at a developing station the latent image formed on said image bearing member, said developing means including plural developing units containing different color developers, respectively, which units are selectively movable to the developing station;

means for transferring at a transfer station an image developed by said developing means onto a transfer material;

said transferring means including transfer material carrying means for carrying the transfer material along an endless path in a predetermined direction and for contacting the transfer material to said image bearing member for the transfer material to receive the developed image from said image bearing member; and means for moving a selected one of said developing units to the developing station during a period in which L3>L2>L1 is satisfied, where L1 is a length of the transfer material carried on the transfer material carrying means which is measured from the transfer station to a trailing edge of the transfer material in a direction opposite to the predetermined direction, L2 is a length of the image bearing member which is measured from the developing station to the transfer station in a direction of movement of said image bearing member, and L3 is a length of the transfer material carrying means which is measured from the transfer station to a leading edge of the transfer material in said opposite direction.

2. An apparatus according to claim 1, wherein said developing means includes supporting means for supporting said developing units, said supporting means being movable by said moving means to selectively place said developing units in the developing station.

3. An apparatus according to claim 2, wherein said supporting means is rotatable by said moving means.

4. An apparatus according to claim 1, wherein developed images produced by said developing units are sequentially transferred superimposedly onto the transfer material carried on said transfer material carrying means.

5. An apparatus according to claim 1, wherein the developing station is common to the plural developing units.

6. A multi-color image forming apparatus, comprising:

a movable image bearing member;

means for forming a latent image on said image bearing member in accordance with information corresponding to a color component image;

developing means for developing at a developing station the latent image formed on said image bearing member, said developing means including plural developing units containing different color developers, respectively, which units are selectively movable to the developing station;

means for transferring an image developed by said developing means onto a transfer material;

said transferring means including transfer material carrying means for carrying the transfer material along an endless path in a predetermined direction and for contacting the transfer material to said image bearing member for the transfer material to receive the developed image from said image bearing member; and means for moving a selected one of said developing units to the developing station, wherein when said transfer material carrying means carries a transfer material of a predetermined size, said moving means imparts an additional movement along the endless path after tne developed image is transferred onto the transfer material, and wherein said moving means moves a selected one of said developing units to the developing station during a period of the additional rotation of the transfer material carrying means.

7. An apparatus according to claim 6, wherein said developing means includes supporting means for supporting said developing units, said supporting means being movable by said moving means to selectively place said developing units in the developing station.

8. An apparatus according to claim 7, wherein said supporting means is rotatable by said moving means.

9. An apparatus according to claim 6, wherein developed images produced by said developing units are sequentially transferred superimposedly onto the transfer material carried on said transfer material carrying means.

10. An apparatus according to claim 6, wherein the developing station is common to the plural developing units.

11. An apparatus according to claim 6, wherein the predetermined size is a maximum size of the transfer material usable with said apparatus.

12. A multi-color image forming apparatus, comprising:

a movable image bearing member;

means for charging said image bearing member;

means for forming a latent image on said image bearing member by exposing said image bearing member, after being charged by said charging means, to light corresponding to a color component image;

developing means for developing at a developing station the latent image formed on said image bearing member, said developing means including plural developing units containing different color developers, respectively, and including movable supporting means for supporting said plural developing units, wherein said developing units are selectively placed by movement of said supporting means in the developing station to develop the latent image;

means for transferring an image developed by said developing means onto a transfer material, said transferring means including transfer material carrying means for carrying the transfer material along an endless path and for contacting the transfer material to said image bearing member for the transfer material to receive the developed image from said image bearing member, said transferring means sequentially transferring images developed by said developing units superimposedly onto the transfer material; and means for moving said supporting means to place a selected one, of said developing units in the developing station during a period after completion of image transfer operation by said transferring means and before start of a next image exposure of said image bearing member.

13. An apparatus according to claim 12, wherein the developing station is common to the plural developing units.

14. An apparatus according to claim 12, wherein said plural developing units each include a developing sleeve for carrying developer and spacer members adjacent longitudinal ends of the developing sleeve for maintaining a constant clearance between said image bearing member and the developing sleeve, wherein when each of the developing units is set at the developing station, the spacer members are contacted to said image bearing member to maintain the constant clearance.

15. An apparatus according to claim 1, 6 or 12, wherein said image bearing member and said transfer material carrying means moves at the same peripheral speed.

16. An apparatus according to claim 1, 6 or 12, wherein said image bearing member is an image bearing drum.

17. An apparatus according to claim 1, 6 or 12, wherein said transfer material carrying means is a transfer material carrying drum.

* * * * *

UNITED STATES PATENT AND TRADEMARK OFFICE

CERTIFICATE OF CORRECTION

PATENT NO. : 4,772,916

DATED : September 20, 1988

INVENTOR(S) : YOSHINORI MOCHIDA

It is certified that error appears in the above-identified patent and that said Letters Patent is hereby corrected as shown below:

COLUMN 2, line 53, "provide" should read --provides--.

COLUMN 4, line 6, "reference 11 a" should read --reference 11 is a--;

line 43, "142" should read --14a--;

line 44, "142" should read --14a--.

COLUMN 5, line 60, "4a" should read --14a--.

COLUMN 6, line 32, "supports" should read --support--.

COLUMN 8, line 68, "about" should read --abut--.

COLUMN 10, line 14, "drum, one" should read --drum, but one--;

line 47, "L3 > L2 > L1" should read --L3 $\geqq$ L2 $\geqq$ L1--.

COLUMN 11, lines 32-33, "moving means imparts" should read --transfer material carrying means makes--;

line 34, "tne" should read --the--;

line 39, "rotation" should read --movement--.

UNITED STATES PATENT AND TRADEMARK OFFICE

CERTIFICATE OF CORRECTION

PATENT NO. : 4,772,916

DATED : September 20, 1988

INVENTOR(S) : YOSHINORI MOCHIDA

It is certified that error appears in the above-identified patent and that said Letters Patent is hereby corrected as shown below:

COLUMN 12, line 31, "one," should read --one--;

line 51, "moves" should read --move--

IN THE DRAWING:

Sheet 2, Fig. 2, "Griprer 201" should read --GRIPPER 201--.

Sheet 7, Fig. 7, "(b) DEVEROPMENT" should read --(b) DEVELOPMENT--.

Signed and Sealed this

Twelfth Day of December, 1989

*Attest:*

JEFFREY M. SAMUELS

*Attesting Officer* *Acting Commissioner of Patents and Trademarks*